US008747660B2

(12) United States Patent
Gordon et al.

(10) Patent No.: US 8,747,660 B2
(45) Date of Patent: Jun. 10, 2014

(54) PROCESS FOR DESULFURIZING PETROLEUM FEEDSTOCKS

(71) Applicant: Ceramatec, Inc., Salt Lake City, UT (US)

(72) Inventors: John Howard Gordon, Salt Lake City, UT (US); Javier Alvare, Cottonwood Heights, UT (US)

(73) Assignee: Ceramatec, Inc., Salt Lake City, UT (US)

( * ) Notice: Subject to any disclaimer, the term of this patent is extended or adjusted under 35 U.S.C. 154(b) by 0 days.

(21) Appl. No.: 13/753,918

(22) Filed: Jan. 30, 2013

(65) Prior Publication Data

US 2013/0140217 A1 Jun. 6, 2013

Related U.S. Application Data

(63) Continuation of application No. 12/916,984, filed on Nov. 1, 2010.

(60) Provisional application No. 61/594,846, filed on Feb. 3, 2012, provisional application No. 61/257,369, filed on Nov. 2, 2009.

(51) Int. Cl.
*C10G 19/08* (2006.01)

(52) U.S. Cl.
USPC ..... 208/235; 205/560

(58) Field of Classification Search
USPC ..... 208/235; 205/560
See application file for complete search history.

(56) References Cited

U.S. PATENT DOCUMENTS

| | | | | |
|---|---|---|---|---|
| 1,501,756 | A | | 7/1924 | Downs |
| 2,836,633 | A | | 5/1958 | Esmay |
| 3,497,569 | A | | 2/1970 | Stiles et al. |
| 3,785,965 | A | | 1/1974 | Welty |
| 3,787,315 | A | * | 1/1974 | Bearden et al. ..... 208/208 M |
| 3,788,978 | A | | 1/1974 | Bearden, Jr. et al. |
| 3,791,966 | A | | 2/1974 | Bearden |

(Continued)

FOREIGN PATENT DOCUMENTS

| | | |
|---|---|---|
| WO | WO-02099013 | 12/2002 |
| WO | WO 2010124030 | 10/2010 |
| WO | WO 2011012900 | 2/2011 |

OTHER PUBLICATIONS

Hwang, Yun K., "International Search Report", PCT App. No. PCT/US2012/065670 (corresponding to U.S. Appl. No. 13/679,696), (Apr. 1, 2013),1-4.

(Continued)

*Primary Examiner* — Randy Boyer
*Assistant Examiner* — Juan Valencia
(74) *Attorney, Agent, or Firm* — David Fonda

(57) ABSTRACT

A process for upgrading an oil feedstock includes reacting the oil feedstock with a quantity of an alkali metal, wherein the reaction produces solid materials and liquid materials. The solid materials are separated from the liquid materials. The solid materials may be washed and heat treated by heating the materials to a temperature above 400° C. The heat treating occurs in an atmosphere that has low oxygen and water content. Once heat treated, the solid materials are added to a solution comprising a polar solvent, where sulfide, hydrogen sulfide or polysulfide anions dissolve. The solution comprising polar solvent is then added to an electrolytic cell, which during operation, produces alkali metal and sulfur.

26 Claims, 7 Drawing Sheets

(56) References Cited

U.S. PATENT DOCUMENTS

| | | | | |
|---|---|---|---|---|
| 3,960,708 | A | 6/1976 | McCollum et al. | |
| 4,076,613 | A | 2/1978 | Bearden, Jr. | |
| 4,428,828 | A | 1/1984 | Bose | |
| 5,328,577 | A | 7/1994 | Murphy | |
| 5,695,632 | A | 12/1997 | Brons et al. | |
| 5,750,814 | A | 5/1998 | Grootjans et al. | |
| 5,935,419 | A | 8/1999 | Khan et al. | |
| 5,935,421 | A | 8/1999 | Brons et al. | |
| 6,210,564 | B1 | 4/2001 | Brons et al. | |
| 6,280,128 | B1 | 8/2001 | Schrader | |
| 6,368,486 | B1 | 4/2002 | Thompson et al. | |
| 6,413,898 | B1 | 7/2002 | Faber et al. | |
| 6,635,795 | B2 | 10/2003 | Gislason et al. | |
| 6,706,902 | B2 | 3/2004 | Sturmann et al. | |
| 6,734,133 | B1 | 5/2004 | Weisbeck et al. | |
| 6,787,019 | B2 | 9/2004 | Jacobson et al. | |
| 7,897,028 | B2 | 3/2011 | Gordon et al. | |
| 8,088,270 | B2 | 1/2012 | Gordon et al. | |
| 2002/0125175 | A1 | 9/2002 | Collins et al. | |
| 2005/0145545 | A1 | 7/2005 | Schucker | |
| 2005/0161340 | A1 | 7/2005 | Gordon et al. | |
| 2006/0054538 | A1 | 3/2006 | Hsu et al. | |
| 2006/0138029 | A1 | 6/2006 | Malek et al. | |
| 2007/0087934 | A1 | 4/2007 | Martens et al. | |
| 2008/0031792 | A1 | 2/2008 | Ciccarelli et al. | |
| 2009/0134040 | A1 | 5/2009 | Gordon et al. | |
| 2009/0259082 | A1 | 10/2009 | Deluga et al. | |
| 2010/0089762 | A1 | 4/2010 | Gordon | |
| 2010/0155298 | A1 | 6/2010 | Raterman et al. | |
| 2010/0276335 | A1* | 11/2010 | Schucker | 208/14 |
| 2010/0297531 | A1 | 11/2010 | Liu et al. | |
| 2010/0297537 | A1 | 11/2010 | Coors et al. | |
| 2010/0304953 | A1 | 12/2010 | Liu et al. | |
| 2011/0054232 | A1 | 3/2011 | Sangar et al. | |
| 2011/0100874 | A1 | 5/2011 | Gordon | |
| 2011/0119994 | A1 | 5/2011 | Hogendoorn et al. | |
| 2011/0155647 | A1 | 6/2011 | Serban et al. | |
| 2012/0304530 | A1 | 12/2012 | Chitta et al. | |
| 2013/0043160 | A1 | 2/2013 | Gordon | |
| 2013/0153469 | A1 | 6/2013 | Gordon | |

OTHER PUBLICATIONS

Hwang, Yun K., "Written Opinion of the International Searching Authority", PCT App. No. PCT/US2012/065670 (corresponding to U.S. Appl. No. 13/679,696), (Apr. 1, 2013), 1-8.

Sternberg, et al., "On the Solubilization of Coal Via Reductive Alkylation", *Preprints of Papers—American Chemical Society*, Division of Fuel Chemistry (1970), 14(1), (available to the public 1984), (1984),87-94.

Bentor, Yinon "Chemical Element.com—Sodium", http://www.chemicalelement.com/elements/na.html, (1996),1-3.

Lee, Dong W., "International Search Report", PCT/US2013/023850 (Corresponding to U.S. Appl. No. 13/753,918), (May 14, 2013),1-3.

Lee, Dong W., "Written Opinion of the International Searching Authority", PCT/US2013/023850 (Corresponding to U.S. Appl. No. 13/753,918), (May 14, 2013), 1-5.

Yu, Jianfei et al., "High temperature naphthenic acid corrosion of steel in high TAN refining media", *Anti-Corrosion Methods and Materials*, vol. 55 Issue 5, (2008),257-63.

Wang, Chen et al., "High Temperature Naphthenic Acid Corrosion of Typical Steels", *Canadian Journal on Mechanical Sciences and Engineering* vol. 2, No. 2, (Feb. 1, 2011),23-30.

Seo, Sang Y., "International Search Report", PCT App. No. PCT/US2012/046939 (Corresponding to U.S. Appl. No. 13/550,313), (Jan. 31, 2013),1-3.

Seo, Sang Y., "Written Opinion of the International Searching Authority", PCT App. No. PCT/US2012/046939 (Corresponding to U.S. Appl. No. 13/550,313), (Jan. 31, 2013), 1-6.

Reggel, et al., "Desulphurization of Gasoline by Metallic Sodium", *Fuel*, vol. 55, (Jul. 1976),170-172.

Byun, Sang H., "International Search Report", International Search Report for PCT US 2010/054984 (Corresponding to U.S. Appl. No. 12/916,984 (Jul. 28, 2011),1-3.

Byun, Sang H., "Written Opinion of the International Searching Authority", Written Opinion for PCT US 2010/054984 (Corresponding to U.S. Appl. No. 12/916,984 (Jul. 28, 2011),1-5.

Kabe, T. et al., "Hydrodesulfurization and Hydrodenitrogenation", *Wiley-VCH* (1999), (1999),110-112.

Task Force on Strat. UNCNV. Fuel, "America's Strategic Unconventional Fuels, vol. III Resource and Technology Profiles", *America's Strategic Unconventional Fuels*, vol. III Resource and Technology Profiles (completed Feb. 2007, Published Sep. 2007)., Full text available at http://www.unconventionalfuels.org/publications/reports/Volume_III_ResourceTechProfiles(Final).pdf,(Sep. 2007),III-25.

Lee, Young W., "International Search Report", PCT/US/2012/039388(corresponding to U.S. Appl. No. 12/916,948), (Dec. 27, 2012),1-3.

Lee, Young W., "Written Opinion of the International Searching Authority", PCT/US/2012/039388 (corresponding to U.S. Appl. No. 12/916,948), (Dec. 27, 2012),1-3.

"Natural Gas", http://www.gasenergia.com.br/portal/ing/gasnatural/dadostecnicos.jsp, (Jun. 10, 2004),1-20.

Sternberg, et al., "Solubilization of Coal via Reductive Alkylation", *Preprints of Papers—American Chemical Society*, Division of Fuel Chemistry (1970), 14(1), 87-94 (available to the public 1984) CODEN: ACFPAI, ISSN: 0569-3772,.(1970),87-94.

Lee, Dong W., "International Search Report", PCT Application No. PCT/US1350194 (Corresponding to U.S. Appl. No. 13/940,336), (Nov. 5, 2013),1-5.

Lee, Dong W., "Written Opinion of the International Searching Authority", PCT Application No. PCT/US1350194 (Corresponding to U.S. Appl. No. 13/940,336), (Nov. 5, 2013),1-5.

Lee, Dong W., "International Search Report", PCT Application No. PCT/US2013/026698 (Corresponding to U.S. Appl. No. 13/770,610), (Aug. 19, 2013),1-5.

Lee, Dong W., "Written Opinion of the International Searching Authority", PCT Application No. PCT/US2013/026698 (Corresponding to U.S. Appl. No. 13/770,610), (Aug. 19, 2013),1-5.

* cited by examiner

PROCESS FOR DESULFURIZING PETROLEUM FEEDSTOCKS

RELATED APPLICATIONS

This application claims the benefit of U.S. Provisional Patent Application Ser. No. 61/594,846 filed Feb. 3, 2012. This application is also a continuation-in-part of U.S. patent application Ser. No. 12/916,984, filed Nov. 1, 2010, entitled "UPGRADING OF PETROLEUM OIL FEEDSTOCKS USING ALKALI METALS AND HYDROCARBONS", which application claims the benefit of U.S. Provisional Patent Application Ser. No. 61/257,369 filed Nov. 2, 2009, entitled "UPGRADING OF PETROLEUM OIL FEEDSTOCKS USING ALKALI METALS AND HYDROCARBONS". All of these prior patent applications are expressly incorporated herein by reference.

U.S. GOVERNMENT INTEREST

This invention was made with government support under Contract No. DE-FE0000408 awarded by the U.S. Department of Energy. The government has certain rights in the invention.

TECHNICAL FIELD

The present invention relates to a process for removing nitrogen, sulfur, and heavy metals from sulfur-, nitrogen-, and metal-bearing shale oil, bitumen, or heavy oil. More particularly, the invention relates to a method of regenerating alkali metals and sulfur from sulfides and polysulfides that were obtained from the sulfur-, nitrogen-, and metal-bearing shale oil, bitumen, or heavy oil.

BACKGROUND

U.S. patent application Ser. No. 12/916,984 (which has been incorporated herein by reference) has been published as United States Patent Application Publication No. 2011/0100874. The reader is presumed to be familiar with the disclosure of this published application. This published application will be referred to herein as the "874 application."

U.S. Pat. No. 8,088,270, which is expressly incorporated herein by reference, relates to a "Process For Recovering Alkali Metals And Sulfur From Alkali Metal Sulfides And PolySulfides." The reader is presumed to be familiar with the disclosure of this published patent. This published patent will be referred to herein as the "'270 patent."

The demand for energy and the hydrocarbons from which that energy is derived is continually rising. The hydrocarbon raw materials used to provide this energy, however, can contain difficult to remove sulfur and metals that hinder their usage. Sulfur can cause air pollution, and can poison catalysts designed to remove hydrocarbons and nitrogen oxide from motor vehicle exhaust. Similarly, other (heavy) metals contained in the hydrocarbon stream can poison catalysts typically utilized for removal of sulfur.

Extensive reserves of shale oil exist in the U.S. that will increasingly play a role in meeting U.S. energy needs. Over 1 trillion barrels reserves lay in a relatively small area known as the Green River Formation located in Colorado, Utah, and Wyoming. As the price of crude oil rises, these shale oil resources become more attractive. However, technical issues surrounding this shale oil remain to be solved. For example, this shale oil has a relatively high amount of nitrogen contained therein (in addition to high levels of heavy metals and sulfur). Shale oil characteristically is high in nitrogen, sulfur, and heavy metals which makes subsequent hydrotreating difficult. According to America's Strategic Unconventional Fuels, Vol. III—Resource and Technology Profiles, p. 111-25, nitrogen is typically around 2% and sulfur around 1% in most samples of shale oil (Heavy metals are also present.) Heavy metals contained in shale oil pose a large problem to upgraders trying to upgrade this shale oil for commercial use. For example, sulfur and nitrogen typically are removed from the shale oil via hydrotreating at elevated temperatures and pressures using catalysts such as Co—Mo/$Al_2O_3$ or Ni—Mo/$Al_2O_3$. However, such catalysts are deactivated (poisoned) by the presence of heavy metals as the heavy metals operate to mask the catalysts.

Another example of a source of hydrocarbon fuel where the removal of sulfur poses a problem is in bitumen existing in ample quantities in Alberta, Canada and heavy oils such as in Venezuela. In order to remove sufficient sulfur from the bitumen for it to be useful as an energy resource, excessive hydrogen must be introduced under extreme conditions, which creates an inefficient and economically undesirable process.

Over the last several years, sodium has been recognized as being effective for the treatment of high-sulfur petroleum oil distillate, crude, heavy oil, bitumen, and shale oil. Sodium is capable of reacting with the oil and its contaminants to dramatically reduce the sulfur, nitrogen, and metal content through the formation of sodium sulfide compounds (sulfide, polysulfide and hydrosulfide). Examples of the processes can be seen in U.S. Pat. Nos. 3,785,965; 3,787,315; 3,788,978; 4,076,613; 5,695,632; 5,935,421; and 6,210,564. This process is further described in the '874 application.

When shale oil, heavy oil or bitumen or other oil feedstock is reacted with the alkali metals, this reaction occurs generally at a temperature between 150-450° C. This reaction is also performed at a pressure that is anywhere between atmospheric pressure and 2000 psi. For example 2 moles alkali metal and 1 mole hydrogen ($H_2$) may be needed per mole sulfur according to the following initial reaction:

$$R—S—R'+2M+H_2 \rightarrow R—H+R'—H+M_2S,$$

Where M is an alkali metal such as sodium or lithium and 3 moles alkali metal and 1.5 moles hydrogen ($H_2$) may be needed per mole nitrogen according to the following initial reaction:

$$R,R',R''—N+3M+1.5H_2 \rightarrow R—H+R'—H+R''—H+M_3N$$

Alternatively, the '874 application describes a method of upgrading an oil feedstock (such as heavy oil, shale oil, bitumen, etc.) by combining the oil feedstock with an alkali metal and an upgradant hydrocarbon material. This reaction operates to remove the sulfur, nitrogen and/or heavy metals contained within the oil feedstock.

It should also be noted that heavy metals contained in the shale oil may also be removed via the use of alkali metals such as sodium. Heavy metals contained in organometallic molecules such as complex porphyrins are reduced to the metallic state by the alkali metal. Once the heavy metals have been reduced, they can be separated from the oil because they no longer are chemically bonded to the organic structure. In addition, once the metals are removed from the porphyrin structure, the nitrogen heteroatoms in the structure are exposed for further denitrogenation.

The following is a summary of the reaction of shale oil, bitumen and/or other oil hydrocarbons when they are reacted with alkali metals, such as lithium or sodium. Liquid phase alkali metal is brought into contact with the organic molecules containing heteroatoms and metals in the presence of hydrogen, methane, and also gases such as nitrogen (or inert gases such as helium, neon, argon, krypton, xenon and radon). The free energy of reaction with organic sulfur, organic nitrogen and organic heavy metals is stronger with alkali metals than with hydrogen, so the reaction more readily occurs without full saturation of the organics with hydrogen. (Hydrogen is generally used in the reaction to cap broken bonds previously attached to heteroatoms and metals, prevent carbon-carbon bonds from forming or coking.) Once the alkali metal compounds are formed and heavy metals are reduced to their metallic states, it is necessary to separate these products from the hydrocarbon materials. A gravimetric separation, such as centrifugation or filtering, can separate the organic, upgraded oil, from the salt phase, metallic phase, and organic solids which may be formed.

Once the alkali metal sulfide has been separated from the oil, sulfur and metals are substantially removed, and nitrogen is moderately removed. Also, both viscosity and density are reduced, while the API gravity is increased. Bitumen or heavy oil would be considered synthetic crude oil (SCO) and can be shipped via pipeline for further refining. Similarly, shale oil will have been considerably upgraded after such processing. Subsequent refining will be easier since the troublesome metals have been removed.

Although the effectiveness of the use of alkali metals such as sodium in the removal of sulfur has been demonstrated, the process is not commercially practiced because a practical, cost-effective method to regenerate the alkali metal has not yet heretofore been proposed. Several researchers have proposed the regeneration of sodium using an electrolytic cell, which uses a sodium-ion-conductive beta-alumina membrane. Beta-alumina, however, is both expensive and fragile, and no significant metal production utilizes beta-alumina as a membrane separator. Further, the cell utilizes a sulfur anode, which results in high polarization of the cell causing excessive specific energy requirements.

Metallic sodium is commercially produced almost exclusively in a Downs-cell such as the cell described in U.S. Pat. No. 1,501,756. Such cells electrolyze sodium chloride that is dissolved in a molten salt electrolyte to form molten sodium at the cathode and chlorine gas at the anode. The cells operate at a temperature near 600° C., a temperature compatible with the electrolyte used. Unlike the sulfur anode, the chlorine anode is utilized commercially both with molten salts as in the co-production of sodium and with saline solution as in the co-production of sodium hydroxide.

Another cell technology that is capable of producing sodium metal at a temperature of less than 200° C. has been disclosed by Jacobsen et al. in U.S. Pat. No. 6,787,019, and Thompson et al. in U.S. Pat. No. 6,368,486. In those disclosures, low temperature co-electrolyte is utilized with the alkali halide to form a low temperature melting electrolyte.

Accordingly, the present embodiments are designed to provide a cost-effective and efficient method for the regeneration of alkali metals used in the desulfurization, denitrogenation, and demetallation of hydrocarbon streams. As will be described herein, the present invention is able to remove contaminants and separate out unwanted material products from desulfurization/denitrogenation/demetallation reactions, and then recover those materials for later use.

SUMMARY

The present embodiments relate to a denitrogenation and desulfurization technology that is insensitive to the heavy metal content and at the same time demetallizes very effectively. The deep demetallization provides an enormous benefit because additional hydrotreating processes will not be affected by the metals originally contained in the shale oil and tar sands.

The present embodiments provide a process for removing nitrogen, sulfur, and heavy metals from sulfur-, nitrogen-, and metal-bearing petroleum feedstocks such as shale oil, bitumen, coker diesel or heavy oil. The present embodiments further provide an electrolytic process of regenerating alkali metals from sulfides, polysulfides, nitrides, and polynitrides of those metals. The present embodiments further provide an electrolytic process of removing sulfur from a polysulfide solution.

One non-limiting embodiment within the scope of the invention includes a process for oxidizing alkali metal polysulfides electrochemically. The process utilizes an electrolytic cell having an alkali ion conductive membrane configured to selectively transport alkali ions, the membrane separating an anolyte compartment configured with an anode and a catholyte compartment configured with a cathode. An anolyte is introduced into the anolyte compartment. The anolyte includes an alkali metal sulfide species and an anolyte solvent that dissolves alkali metal sulfide species. A catholyte is introduced into the catholyte compartment. The catholyte may be comprised of molten alkali metal or may include alkali metal ions and a catholyte solvent. The catholyte solvent may include one of many non-aqueous solvents such as tetraglyme, diglyme, dimethyl carbonate, dimethoxy ether, propylene carbonate, ethylene carbonate, diethyl carbonate. The catholyte may also include an alkali metal salt such as an iodide or chloride of the alkali metal. Applying an electric current to the electrolytic cell oxidizes sulfur in the anolyte compartment to form elemental sulfur, causes alkali metal ions to pass through the alkali ion conductive membrane from the anolyte compartment to the catholyte compartment, and reduces the alkali metal ions in the catholyte compartment to form elemental alkali metal.

Sulfur has higher specific gravity than the anolyte and is easily separated from the anolyte by gravimetric means, centrifugal separation or may be recovered by removing a portion of the anolyte solution from the anolyte compartment, cooling the removed anolyte solution to precipitate solid phase sulfur from the anolyte solution, separating the precipitated sulfur from the anolyte solution. In the preferred embodiment, the cell is operated at 115° C. or greater such that the sulfur formed at the anode is in the liquid phase. If the alkali metal is sodium, then the sodium formed at the cathode is also liquid phase.

By operating the cell at a temperature below the melting temperature of the alkali metal (e.g., if, for example, if the alkali metal is lithium), elemental alkali metal will plate onto the cathode. The cathode may be periodically withdrawn from the catholyte compartment to remove the alkali metal. Alternatively, in one embodiment within the scope of the invention, the cathode may be configured as a flexible band which continuously or semi-continuously loops from inside the catholyte compartment to outside the catholyte compartment and electrolytic cell housing, enabling the alkali metal to be continuously scraped or removed from the cathode.

The present invention may provide certain advantages, including but not limited to the following:

Operating an electrolytic cell to process an alkali metal sulfide or polysulfide at temperatures below the melting temperature of the alkali metal;

Operating an electrolytic cell continuously or semi-continuously to process an alkali metal sulfide or polysulfide at temperatures below the melting temperature of the alkali metal;

Removing an alkali metal continuously or semi-continuously in solid form from the cell;

Removing high alkali metal polysulfides and dissolved sulfur continuously or semi-continuously from the electrolytic cell;

Separating sulfur continuously or semi-continuously from a stream containing a mixture of solvent, sulfur, and alkali metal polysulfides such that the solvent and alkali metal polysulfides are substantially recovered such that they can be returned back to an electrolytic process; and

DETAILED DESCRIPTION

The present embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the methods and cells of the present invention, as represented in the Figures, is not intended to limit the scope of the invention, as claimed, but is merely representative of present embodiments of the invention.

Figure 1:
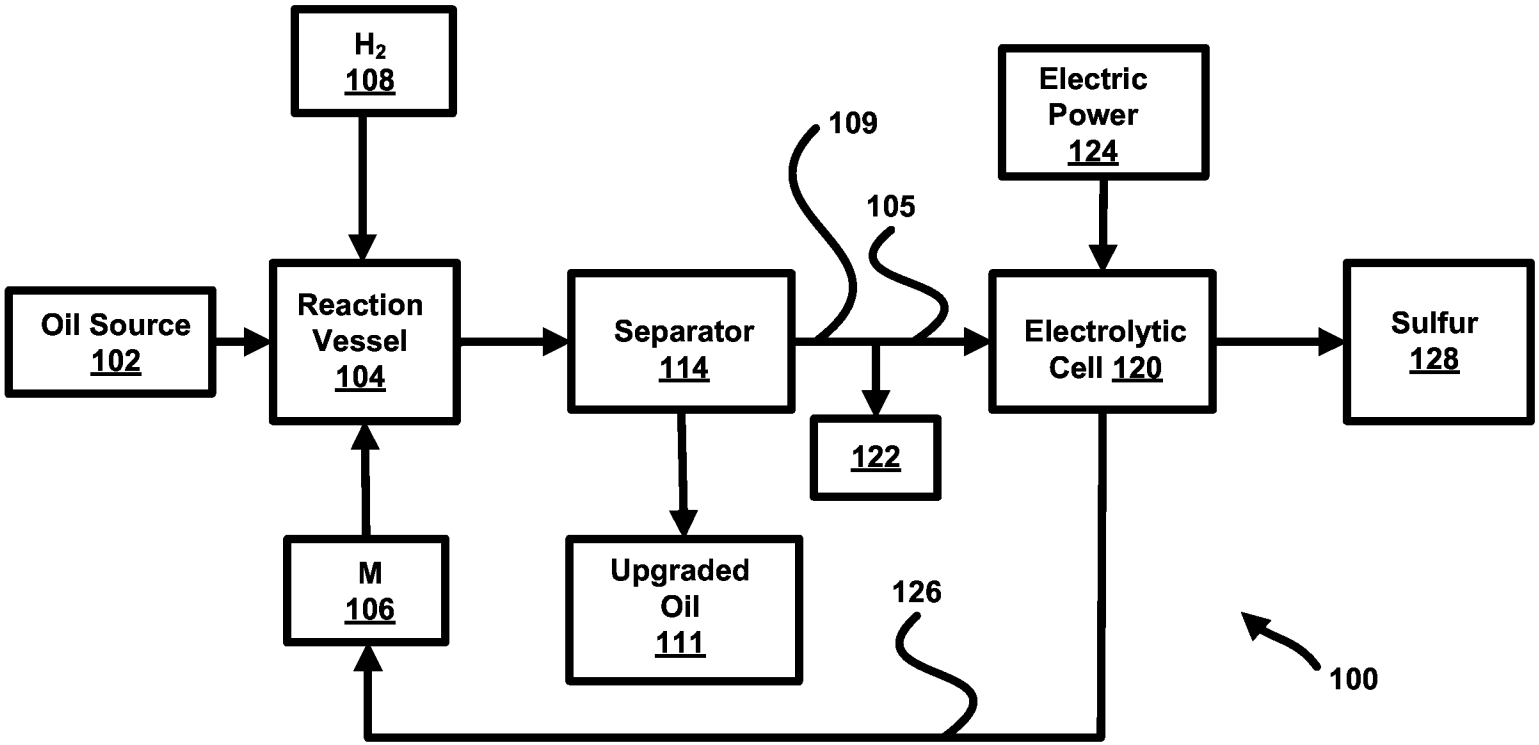
FIG. 1 shows an overall process for upgrading an oil feedstock that removes nitrogen, sulfur, and heavy metals from sulfur-, nitrogen-, and metal-bearing oil sources using an alkali metal and regenerates the alkali metal.

The overall process is shown schematically in FIG. 1 of one non-limiting embodiment for removing nitrogen, sulfur, and heavy metals from sulfur-, nitrogen-, and metal-bearing oil sources using an alkali metal and for regenerating the alkali metal. In the process 100 of FIG. 1, an oil source 102, such as high-sulfur petroleum oil distillate, crude, heavy oil, bitumen, or shale oil, is introduced into a reaction vessel 104. As described above, this oil source 102 may have heavy metals, sulfur and/or nitrogen containing compounds within the oil feedstock 102. An alkali metal (M) 106, such as sodium or lithium, is also introduced into the reaction vessel 104, together with a quantity of hydrogen gas 108 or other gas which may cap the radicals formed when the bonds with heteroatoms, and metals are broken. The alkali metal 106 and hydrogen 108 react with the oil source 102 and its contaminants to dramatically reduce the sulfur, nitrogen, and metal content through the formation of sodium sulfide compounds (sulfide, polysulfide and hydrosulfide) and sodium nitride compounds.

The alkali metal (M) and hydrogen react with the oil 102 at about 300-400° C. and 300-2000 psi according to the following initial reactions:

$$R—S—R'+2M+H2 \rightarrow R—H+R'—H+M2S, \text{ and}$$

$$R,R',R''—N+3MNa+1.5H2 \rightarrow R—H+R'—H+R''—H+MNa3N$$

Where M is an alkali metal such as sodium or lithium and where R, R', R" represent portions of organic molecules or organic rings.

Solids from the reaction of alkali metal with petroleum feedstocks may be separated in numerous ways including gravimetric, centrifugal methods, and filtering. Such separation of the solids may be conducted within a separator 114. The upgraded oil product 111, which has reduced amounts of heavy metals, sulfur and nitrogen containing compounds, may be obtained from the separator 114.

The solids may be washed with a light petroleum substance such as hexane, heptane, toluene or mixtures of these substances, or natural gas condensate, other hydrocarbon liquids, or the like to remove adhered liquid product. The light petroleum substance may be stripped away by distillation for example to leave behind product liquid that is re-added to the upgraded oil. The light petroleum substance may be reused for further washing of solids.

Solids separated from the petroleum reacted with alkali metal typically are a mixture of organic and inorganic constituents. To facilitate separation of the organic from inorganic and to prevent adverse reactions and resistive coating of electrodes and membranes, the solids may be treated by heating in the substantial absence of oxygen or water. Such heating may occur, for example under the presence of nitrogen, or hydrocarbon gases such as methane. Such heating may involve heating to a temperature above 400° C. and preferably above 500° C. During this heating process, light gases are formed and may be recovered. (These gases may be, for example, methane or other hydrocarbons.) This heating process may be referred to as "heat treating" 109.

Following this heat treating process 109 (and subsequent cooling), the alkali metal sulfides found in the solid materials may be dissolved in solvent such as formamide, methyl formamide, dimethyl formamide, acetamide, methyl acetamide, dimethyl acetamide, ethylene glycol, propylene glycol, 1,2-ethanediol, 1,2-propanediol, propylene carbonate, ethylene carbonate, diethyl carbonate, N-methylpyrrolidone, tetraethylene glycol dimethyl ether (tetralglyme), acetonitrile, dimethyl sulfoxide, liquid ammonia, methyl amine or 1,3-Dimethyl-3,4,5,6-tetrahydro-2(1H)-pyrimidinone (DMPU) or combinations of the above. Once dissolved, any undissolved portion of solids 122 may be removed by filtration or centrifugal means. These undissolved solids may be rich with metals that were originally in the petroleum feedstock. The dissolved sulfides may be fed into the anolyte compartment of the electrolytic cell.

The solid material dissolved in the solvent (which includes the alkali metal sulfides, hydrogen sulfides or polysulfides), as shown by arrow 105, may be further processed in an electrolytic cell 120 to remove and recover sulfur and to remove and recover the alkali metal. (One example of this type of electrolytic cell 120 is shown in FIG. 2.)

The electrolytic cell 120 receives a solution of the alkali sulfide or polysulfide in a solvent such as formamide, methyl formamide, dimethyl formamide, acetamide, methyl acetamide, dimethyl acetamide, ethylene glycol, propylene glycol, 1,2-ethanediol, 1,2-propanediol, propylene carbonate, ethylene carbonate, diethyl carbonate, N-methylpyrrolidone, tetraethylene glycol dimethyl ether (tetralglyme), acetonitrile, dimethyl sulfoxide, liquid ammonia, methyl amine, or 1,3-Dimethyl-3,4,5,6-tetrahydro-2(1H)-pyrimidinone (DMPU) or combinations of the above. Under the influence of a source electric power 124, alkali metal ions are reduced to form the alkali metal (M) 126, which may be recovered and used as a source of alkali metal 106. Sulfur 128 is also recovered from the process of the electrolytic cell 120. A detailed discussion of one possible electrolytic cell that may be used in the process within the scope of the present invention is described in conjunction with FIGS. 2, 5 and 6.

It should be noted that the treatment of the solid material by heating before dissolving in the polar solvent may be beneficial to the overall process for upgrading the petroleum product. If this "heat-treating" 109 of the solid is not performed, when the materials are added to the electrolytic cell 120, the electrolytic cell will ultimately be "gummed up" or failed. Specifically, organic materials that are present in the materials, if not removed via heat treating, will be deposited on the electrodes, thereby causing the electrodes to fail. However, by heating the solids in the manner described above, the organic materials that would normally fail the electrodes are removed (such as through conversion into methane or another gaseous product). Thus, by heat-treating 109 the solids in the manner outlined herein, significant advantages may be obtained.

Figure 2:
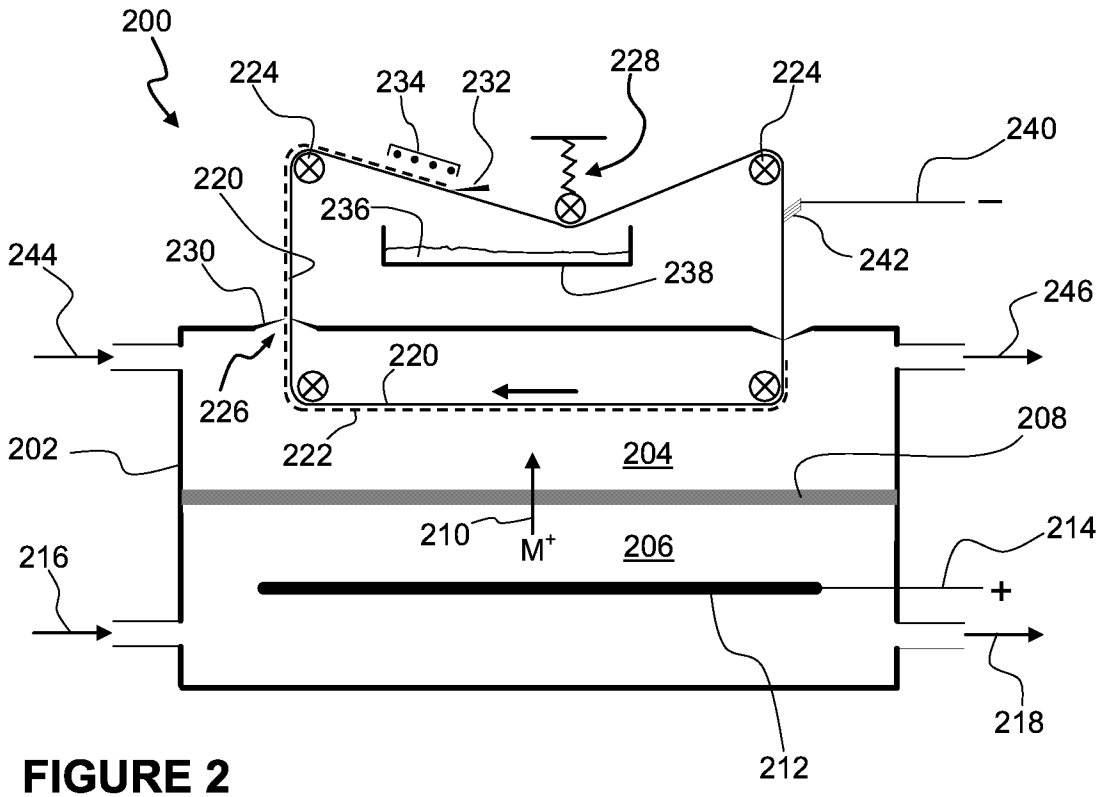
FIG. 2 shows a schematic cross-section of an electrolytic cell that may be used to regenerate the alkali metal and sulfur used to react with sulfur-, nitrogen-, and metal-bearing oil sources.

FIG. 2 shows a schematic cross-section of an electrolytic cell 200 which utilizes many of the features within the scope of the invention. As described above, after "heat treating" 109 the solid material (and removing the solids), the liquid containing dissolved sodium and sulfides may be added to an electrolytic cell. FIG. 2 shows one example of this type of cell that will receive the "heat treated" liquid.

As shown in FIG. 2, electrolytic cell housing 202 is constructed to enclose a liquid solvent mixture. The material of construction preferably is an electrically insulative material such as most polymers. The material also is preferably chemically resistant to solvents. Polytetrafluoroethylene (PTFE) is particularly suitable, as well as Kynar® (which is a commercially available synthetic resin), polyvinylidene fluoride, or high density polyethylene (HDPE). The cell housing 202 may also be fabricated from a non-insulative material and non-chemically resistant materials, provided the interior of the housing 202 is lined with such an insulative and chemically resistant material. Other suitable materials would be inorganic materials such as alumina, silica, alumino-silicate and other insulative refractory or ceramic materials.

The internal space of housing 202 is divided into a catholyte compartment 204 and anolyte compartment 206 by a divider 208. The divider 208 preferably is substantially permeable only to cations and substantially impermeable to anions, polyanions, and dissolved sulfur. The divider 208 may be fabricated in part from an alkali metal ion conductive material. If the metal to be recovered by the cell is sodium, a particularly well suited material for the divider is known as NaSICON which has relatively high ionic conductivity at room temperature. A typical NaSICON composition substantially would be $Na_{1+x}Zr_2Si_xP_{3-x}O_{12}$ where $0<x<3$. Other NaSICON compositions are known in the art. Alternatively, if the metal to be recovered in the cell is lithium, then a particularly well suited material for the divider would be lithium titanium phosphate (LTP) with a composition that is substantially, $Li_{(1+x+4y)}Al_xTi_{(1-x-y)}(PO_4)_3$ where $0<x<0.4$, $0<y<0.2$. Other suitable materials may be from the ionically conductive glass and glass ceramic families and have the general composition $Li_{1+x}Al_xGe_{2-x}PO_4$. Other lithium conductive materials are known in the art. The divider 208 may have a portion of its thickness which has negligible through porosity such that liquids in the anolyte compartment 206 and catholyte compartment 204 cannot pass from one compartment to the other, but substantially only alkali ions ($M^+$) 210, such as sodium ions or lithium ions, can pass from the anolyte compartment 206 to the catholyte compartment 204. The divider may also be comprised in part by an alkali metal conductive glass-ceramic such as the materials produced by Ohara Glass of Japan.

The anode 212 is located within the anolyte compartment 206. It may be fabricated from an electrically conductive material such as stainless steel, nickel, iron, iron alloys, nickel alloys, and other anode materials known in the art. The anode 212 is connected 214 to the positive terminal of a direct current power supply. The anode 212 may be a mesh, monolithic structure or may be a monolith with features to allow passage of anolyte through the anode structure. Anolyte solution is fed into the anolyte compartment through an inlet 216 and passes out of the compartment through and outlet 218. The electrolytic cell 200 can also be operated in a semi-continuous fashion where the anolyte compartment is fed and partially drained through the same passage.

The electronically conductive cathode 220 is in the form of a strip or band that has a portion within the catholyte compartment 204 and a portion outside the catholyte compartment 204 and cell housing 202, such that the alkali metal 222 can plate onto the cathode 220 while it is in the catholyte compartment 204. The alkali metal 222 can be stripped off the cathode while it is outside the catholyte compartment. Rotating rollers 224 can define the path of the cathode 220 where the path passes near the divider 208 in the catholyte compartment 204, exits the housing 202, passes through a section where the alkali metal is removed from the cathode band 220, then re-enters the housing and returns near the divider 208. One or more of the rollers may be driven by a motor or driving mechanism (not shown) to cause the cathode 220 to move through an opening 226 in the housing 202 and pass out of the housing continuously, semi-continuously or periodically.

One or more of the rollers may be attached to tensioning devices 228 to allow the cathode 220 to remain at an acceptable level of tension as the cathode band expands or contracts with temperature fluctuations and strains from stress. Wiping seals 230 remove catholyte solution from the cathode 220 as it egresses the cell so that the catholyte is returned back to the catholyte compartment. The cathode band may be fabricated from steel, flexible metal alloys, and other conductive materials suitable for its intended purpose. A scraper 232 can be used to remove the plated alkali metal 222 from the cathode 220 as it moves. Alternatively, the cathode may be exposed to a heated zone 234 that melts the alkali metal off of the cathode 220. The removed alkali metal 236 may fall into a container 238 which may have a conveyance system (not shown) to transfer the alkali metal 236 away from the cell 200 to a storage area or point of use.

The cathode 220 is polarized by a connection 240 to the negative terminal of a power supply. This connection may be made with an electronically conductive brush 242 that contacts the cathode 220 or it may be made through one or more of the rollers 224 contacting the cathode belt. The catholyte compartment 204 may have an inlet port 244 and an outlet port 246 to transfer catholyte solution in and out of the catholyte compartment 204 when required.

Within the catholyte compartment is an alkali ion conductive liquid which may include a polar solvent. Non-limiting examples of suitable polar solvents are tetraglyme, diglyme, dimethyl carbonate, dimethoxy ether, propylene carbonate, ethylene carbonate, diethyl carbonate and such. An appropriate alkali metal salt, such as a chloride, bromide, iodide, perchlorate, hexafluorophosphate or such, is dissolved in the polar solvent to form that catholyte solution.

One non-limiting example of the operation of the electrolytic cell 200 is described as follows: Anolyte solution containing approximately 60-100% polar solvent such asformamide, methyl formamide, dimethyl formamide, acetamide, methyl acetamide, dimethyl acetamide, ethylene glycol, propylene glycol, 1,2-ethanediol, 1,2-propanediol, propylene carbonate, ethylene carbonate, diethyl carbonate, N-methyl pyrrolidone, tetraethylene glycol dimethyl ether (tetralglyme), acetonitrile, dimethyl sulfoxide, liquid ammonia, methyl amine or 1,3-Dimethyl-3,4,5,6-tetrahydro-2(1H)-pyrimidinone (DMPU) or combinations of the above, and 0-40% apolar solvent such as N,N-dimethylaniline (DMA) or quinoline, and 1% to saturation, sodium polysulfide relative to the total solvent, is fed into the anode compartment 206. The electrodes are energized such that there is an electrical potential between the anode 212 and the cathode 220 that is greater than the decomposition voltage which ranges between about 1.8 V and about 2.5 V depending on the composition. Concurrently, sodium ions pass through the divider into the cathode compartment 204, sodium ions are reduced to the metallic state and plate onto the cathode belt 220, and polysulfide is oxidized at the anode such that low polysulfide anions become high polysulfide anions and/or elemental sulfur forms at the anode. While sulfur is formed it is dissolved into the anolyte solvent in entirety or in part.

The sodium plated onto the belt is removed from the cell as the cathode belt is advanced then subsequently the alkali metal 222 is removed from the cathode belt 220 by scraping or melting outside of the cell. The catholyte is comprised of a polar solvent such as tetraglyme and a salt to increase the ionic conductivity. For example, in this case sodium halide salt such as sodium chloride can be used to increase the ionic conductivity and the decomposition voltage of sodium chloride is much higher than the decomposition of sodium polysulfide. The electrolytic cell 200 is operated at a temperature below the melting temperature of sodium. To minimize cell heating due to resistive losses, the anode and cathode may be spaced relatively close to the divider 208, within a few millimeters. Adjustments to cell temperature can be made using a heat exchanger on the flow of anolyte entering and exiting the cell through ports 216, 218.

The cell shown in FIG. 2 has a general horizontal orientation but could also be configured in a generally vertical or other orientation.

In the case of the alkali metal being sodium, the following typical reactions may occur in the electrolytic cell 200:

At the Cathode:

$$Na^{+}+e^{-}\rightarrow Na$$

At the Anode:

$$Na_2S_x\rightarrow Na^{+}+e^{-}+1/2Na_2S_{(2x)}$$

$$Na_2S_x\rightarrow Na^{+}+e^{-}1/2Na_2S_x+x/16S_8$$

Where x ranges from 0 to about 8 but may be greater than 8.

As noted above, because the liquid that was added to the cell 200 previously had undergone a "heat treating" process, this cell 200 does not have organic materials foul the electrodes.

Figure 3:
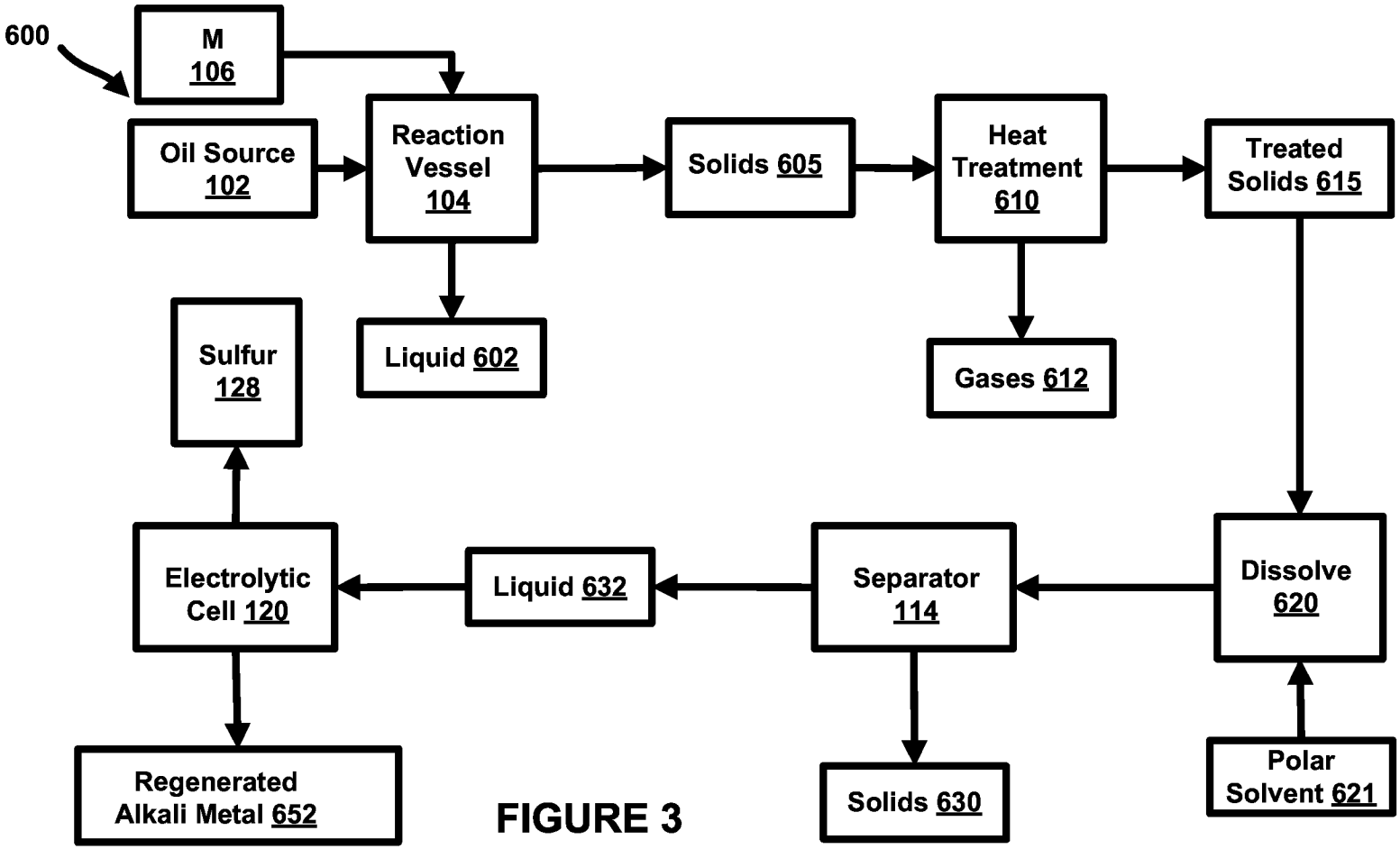
FIG. 3 shows a schematic of a process for upgrading the oil and regenerating the sulfur and alkali metal.

Referring now to FIG. 3, a schematic diagram of a method 600 for regenerating sulfur and an alkali metal from an oil source is described. Specifically, the method 600 includes an oil source 102 of the type described herein. This oil source 102 is reacted within a reactor 104 with a quantity of an alkali metal 106, in the manner outlined above. Once reacted, a liquid material 602 is produced. (This liquid material 602 may simply be referred to as "liquid 602.") This liquid 602 may be the upgraded oil product. In addition to liquid product 602, a quantity of solid materials 605 (which may be simply called "solids") are produced.

The produced solids 605 may be washed with a light petroleum substance such as hexane, heptane, toluene, or mixtures of these substances, or natural gas condensate, or the like to remove adhered liquid product 602. The light petroleum substance may be stripped away by distillation, for example, to leave behind liquid product. This liquid product may then be re-added to the liquid 602. The light petroleum substance, which was stripped away, may be re-used in washing another batch of solids 605.

The solids 605 may include quantities of heavy metals, coke, organic solids, sodium sulfide, sodium nitride, etc. These solids 605 may then be subjected to a heat treatment step 610. In this heat treatment, the solids 605 are heated in a substantial absence of oxygen or water, for example under the presence of nitrogen, an inert gas or hydrocarbon gases such as methane. Such heating may involve heating the solids 605 to a temperature above 400° C. and preferably above 500° C. As part of this heat treatment procedure 610, a quantity of treated solids 615 are produced. Further, during the heat treatment procedure, a quantity of gases 612 (such as methane or other organic gases) is also produced. It is believed that this heat treatment step 610 operates to convert some of the organic products, such as coke, within the solids 605 into methane or other volatile organics, such that these gases are removed from the solids 605. As a result of the gases 612 being emitted, the weight of the treated solids 615 is generally less than the weight of the solids 605 (given that some of the mass of the solids 605 has been lost as organic gases.) After undergoing this heat treatment procedure, the solids 615 may be more granular than they were previously.

Once treated by this heat treatment step 610, the treated solids 615 may then be dissolved, in step 620, in a solution comprising a polar solvent 621. Once dissolved, the material is added to a separator 114. Within this separator 114, solids 630 will be removed. Such solids 630 may include residual coke and heavy metal products. Such solids 630 can literally fall to be bottom of the separator 114, and thus may be removed by gravimetric processes, filtration or other methods.

Once the solids 630 are removed, a resulting liquid 632 is formed. This liquid 632 may be yellowish to clear in color as a result of the presence of dissolved sodium sulfide. (Polysulfide and/or hydrogen sulfide anions may also be present.) This liquid 632 may be introduced into an electrolytic cell 120. Any electrolytic cell may be used, including the cells 120, 200 described above. Other types of electrolytic cells, including those described in the '270 patent or the '874 application, may also be used. While in this cell 120, electricity is added to conduct an electrolytic reaction which operates to oxidize the sulfide anions into polysulfide ions and sulfide and polysulfide ions into sulfur 128 (which may be collected, re-used, sold, etc.) as well as regenerated alkali metal 652. This regenerated alkali metal 652 may then be re-used in the reaction vessel 104 as a means of upgrading a further batch of oil products. A portion of the anolyte from the cells 120 may serve as the polar solvent 621.

Most sodium is produced commercially from electrolysis of sodium chloride in molten salt rather than sodium polysulfide, but the decomposition voltage and energy requirement is about half for polysulfide compared to chloride as shown in Table 1.

TABLE 1

Decomposition voltage and energy (watt-hour/mole) of sodium and lithium chlorides and sulfides

| | NaCl | $Na_2S$ | LiCl | $Li_2S$ |
|---|---|---|---|---|
| V | 4.0 | <2.1 | 4.2 | 2.3 |
| Wh/mole | 107 | <56 | 114 | 60 |

The open circuit potential of a sodium/polysulfide cell is as low as 1.8V when a lower polysulfide, $Na_2S_3$ is decomposed, while the voltage rises with rising sulfur content. Thus, it may be desirable to operate a portion of the electrolysis using anolyte with lower sulfur content. In one embodiment, a planar NaSICON or Lithium Titanium Phosphate (LTP) membrane is used to regenerate sodium or lithium, respectively. NaSICON and LTP have good low temperature conductivity as shown in Table 2. The conductivity values for beta alumina were estimated from the 300° C. conductivity and activation energy reported by May. G. May, *J. Power Sources,* 3, 1 (1978).

TABLE 2

Conductivities of NaSICON, LTP, Beta alumina at 25° C., 120° C.

| | Conductivity mS/cm | | |
|---|---|---|---|
| Temperature ° C. | NaSICON | LTP | Beta alumina (est) |
| 25 | 0.9 | 0.9 | 0.7 |
| 120 | 6.2 | 1.5 | 7.9 |

The anolyte solution may be preferably selected to dissolve polysulfides and sulfur. U.S. Pat. No. 6,852,450 to Hwang et al. discloses a high cathode (sulfur electrode) utilization by using a mixture of polar and apolar solvents. The polar solvents were useful for dissolving most of the polysulfides that are polar in nature and the apolar solvent is useful for dissolving the sulfur that is apolar in nature. A mixture of polar and apolar solvents may be used in anolyte solution within the scope of the present invention, but it is not required. If the electrolytic cells are operated above the melting temperature of sulfur, it may not be necessary to use an apolar solvent for the purposes of completely dissolving the sulfur, but the apolar solvent will likely reduce the polarization of the anode. Hwang measured the solubility of sulfur and found numerous solvents with relatively high solubility. Hwang did not report the solubility of polysulfides. The top eight solvents were cyclohexane, benzene, trifluortoluene, toluene, fluorbenzene, tetrahydrofurane (THF) and 2-methyl tetrahydrofurane (2-MeTHF). The first six have solubilities above 80 mM while the last two have solubilities above 40 mM. To separate the sulfur, a portion of the anolyte from the high polysulfide cells will be bled off and processed, as discussed herein. Some of the sulfur may be removed by cooling and gravimetrically separating or through filtration. Other methods may also be used such as vaporizating the apolar solvent then using gravimetric or filtration means.

Table 3 lists the eight solvents with highest sulfur solubility based on the findings of U.S. Pat. No. 6,852,450. This patent did not specify but the solubilities listed are probably for temperatures near 25° C. and would be higher at elevated temperatures. Table 3 also lists the boiling points of those solvents. The data is arranged in order of boiling point temperature. Based on this data, the most suitable solvents to be added to the anolyte are xylene, toluene and trifluorotoluene. Operation at pressures above ambient may be desirable to keep the solvent from vaporizing at operating temperatures near 120° C., particularly since most of the domestic shale oil would be processed at elevations between 4000-8000 feet above sea level.

TABLE 3

Sulfur solubility and boiling point of eight solvents, high solubility

| Solvent | Sulfur Solubility (mM) | Boiling Point (° C.) |
|---|---|---|
| Xylene | 77 | 140 |
| Toluene | 84 | 111 |
| Trifluorotoluene | 78 | 103 |
| Fluorobenzene | 83 | 85 |
| Cyclohexane | 93 | 81 |
| Benzene | 88 | 80 |
| 2-Me THF | 44 | 80 |
| THF | 48 | 66 |

Conversely, Table 4 lists eight solvents with low sulfur solubility based on U.S. Pat. No. 6,852,450. Composing anolyte from one or more solvents from Table 3 and one or more solvents from Table 4 may be desirable such that apolar solvent dissolves sulfur and a polar solvent dissolves the polar polysulfide. If the process is run in stages, it may be useful to have the polar solvent in the low polysulfide cells because they should contain negligible amounts of sulfur. Based on boiling point in Table 4, tetraglyme, and diglyme would be the best candidate solvents for the anolyte, given operating temperature of 120° C.

TABLE 4

Sulfur solubility and boiling point of eight solvents, low solubility

| Solvent | Sulfur Solubility (mM) | Boiling Point (° C.) |
|---|---|---|
| Tetraglyme | 1.4 | 275 |
| Diglyme | 1.5 | 162 |
| Isopropanol | 1.0 | 108 |
| Ethyl Propianal | 1.7 | 99 |
| Dimethyl Carbonate | 0.8 | 90 |
| Dimethoxy ether | 1.3 | 85 |
| Ethanol | 0.9 | 78 |
| Ethyl acetate | 1.5 | 77 |

Sulfur has been found to be soluble to an extent in tetraglyme and the solubility rises with increasing temperature. Adding an apolar solvent such as N,N-dimethylaniline (DMA) increases the sulfur solubility. The sulfur solubilities versus temperature for tetraglyme, DMA and mixture of tetraglyme and DMA, 80:20 by weight are shown in Table 5 below:

TABLE 5

Sulfur solubility in solvents versus temperature (wt %)

| Temp ° C. | TG | DMA | 80:20 TG:DMA |
|---|---|---|---|
| 25 | 0.16 | 3.37 | 0.46 |
| 50 | 1.01 | 6.92 | 1.26 |
| 70 | 1.16 | 10.7 | 1.89 |

Tetraglyme alone can dissolve sulfur formed at the anode to an extent, particularly if the cells operate at elevated temperatures above 50° C. Addition of selected solvents such as DMA enables the solvent to dissolve more sulfur, preventing polarization at the anode.

If the electrolytic cells operate at an even slightly elevated temperature of about 70° C., a stream of anolyte solution near saturation can be brought outside the electrolytic cell and chilled using a heat exchanger or other means to cause sulfur to precipitate. The sulfur can be removed by one of several means such as filtration, gravimetrically, centrifugation, and such. Sulfur has nearly two (2) times the specific gravity of the solvent mixture and is easily separated. The sulfur depleted solvent then can be returned to the anolyte to reduce the overall sulfur concentration in the anolyte.

Figure 4:
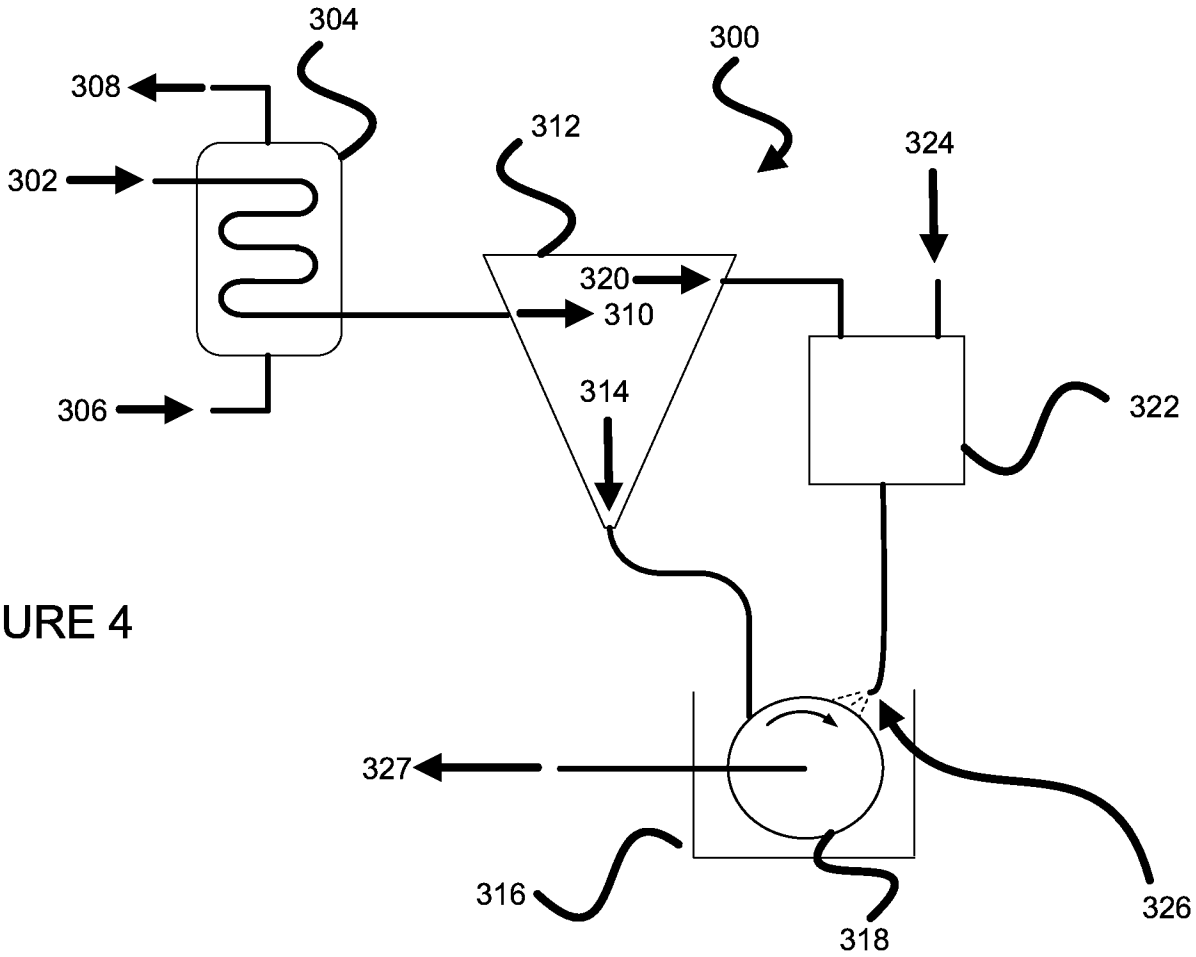
FIG. 4 shows a schematic of an apparatus which can process electrolytic cell anolyte to extract sulfur.

Once the solution of sodium and sulfides are added to the cell, sulfur may be obtained. FIG. 4 discloses a schematic of an exemplary embodiment of a system 300 to remove sulfur from the anolyte solution. Referring to FIG. 4, warm sulfur laden anolyte solution 302 enters heat exchanger 304. Coolant 306 from a chiller or cooling tower (not shown) cools down the anolyte through heat exchange. Coolant from the heat exchanger 308 returns back to the chiller. As the sulfur laden anolyte solution 302 is cooled, sulfur precipitates or forms a second liquid phase as the solubility within the anolyte decreases. The chilled anolyte 310 enters an enclosed thickener 312 to allow settling of solid phase sulfur or sulfur liquid phase. A stream heavily containing sulfur solids 314 flows to a rotary filter 316. Liquid anolyte flows into the filter while solid sulfur remains on the filter media on the outside of the drum 318. Overflow anolyte from the thickener 320 enters a tank 322 that also receives make-up solvent mixture 324. Together this stream is used as a spray 326 to wash the sulfur filter cake. The sulfur filter cake is removed from the rotary filter enclosure by a conveyor means (not shown). Chilled and low sulfur bearing anolyte 327 is pumped from the filter drum back to the electrolytic cell. The stream 326 may be heat exchanged with stream 302 in a heat exchanger (not shown) to heat up the anolyte before returning it to the electrolytic cell and to reduce the temperature of the anolyte entering the chilled heat exchanger 304. Sulfur liquid phase may be separated directly from the bottom of the thickener 312. It will be appreciated that many alternative approaches and variations to this process of removing sulfur from the anolyte solution are possible. It may also be appreciated that a second phase of liquid sulfur may form within the cells 120 and may settle in a thickener 312, without chilling.

Other anolyte solvents which may be utilized to increase sulfur solubility in the anolyte solution include: tetrahydrofuran, 2-methyl tetrahydrofuran, benzene, cyclohexane, fluorobenzene, thrifluorobenzene, toluene and xylene. Other polar solvents which may be used to dissolve polysulfides include: tetraglyme, diglyme, isopropanol, ethyl propional, dimethyl carbonate, dimethoxy ether, ethanol and ethyl acetate, propylene carbonate, ethylene carbonate, diethyl carbonate and such.

Another non-limiting example on a process within the scope of the present invention is like the one disclosed above except lithium polysulfide is decomposed. Lithium ions pass through the divider and lithium metal is reduced at the cathode inside the cell and scraped off outside the cell.

The '270 patent discloses an embodiment in which after the oil stream has been reacted with an alkali metal, the product stream may further be reacted with $H_2S$, thereby converting the sodium sulfide products into NaHS (and the nitride products into ammonia gas and NaHS). It should be noted that once these reactions have occurred, the solid products (which contain the heavy metals and the NaHS products) may be washed with the toluene (or other solvent) in the manner outlined herein. This washing liquid will then be removed and the formed liquid (which includes upgraded oil products) may be re-added to the liquid upgraded oil feedstock.

The washed solids may then be heat-treated, in the manner outlined above. This heat treatment of the solids (which include NaHS and heavy metals) occurs at a temperature above 400 or 500° C., and occurs under nitrogen, methane, or another non-oxidizing environment. During this heat-treating, some of the organic materials that were present in the solids (such as coke materials) will be converted into methane and removed from the solid. Thus, the mass of the solid materials after heat-treating may be less than the mass of the solids before heat-treating.

This heat-treated solid material (which contains NaHS) may then be dissolved in a polar solvent so that the heavy metals may be separated out. The resulting liquid material, which includes dissolved NaHS and the polar solvent, is added to a cell so that the S and the Na may be recovered, in the manner outlined herein.

Figure 5:
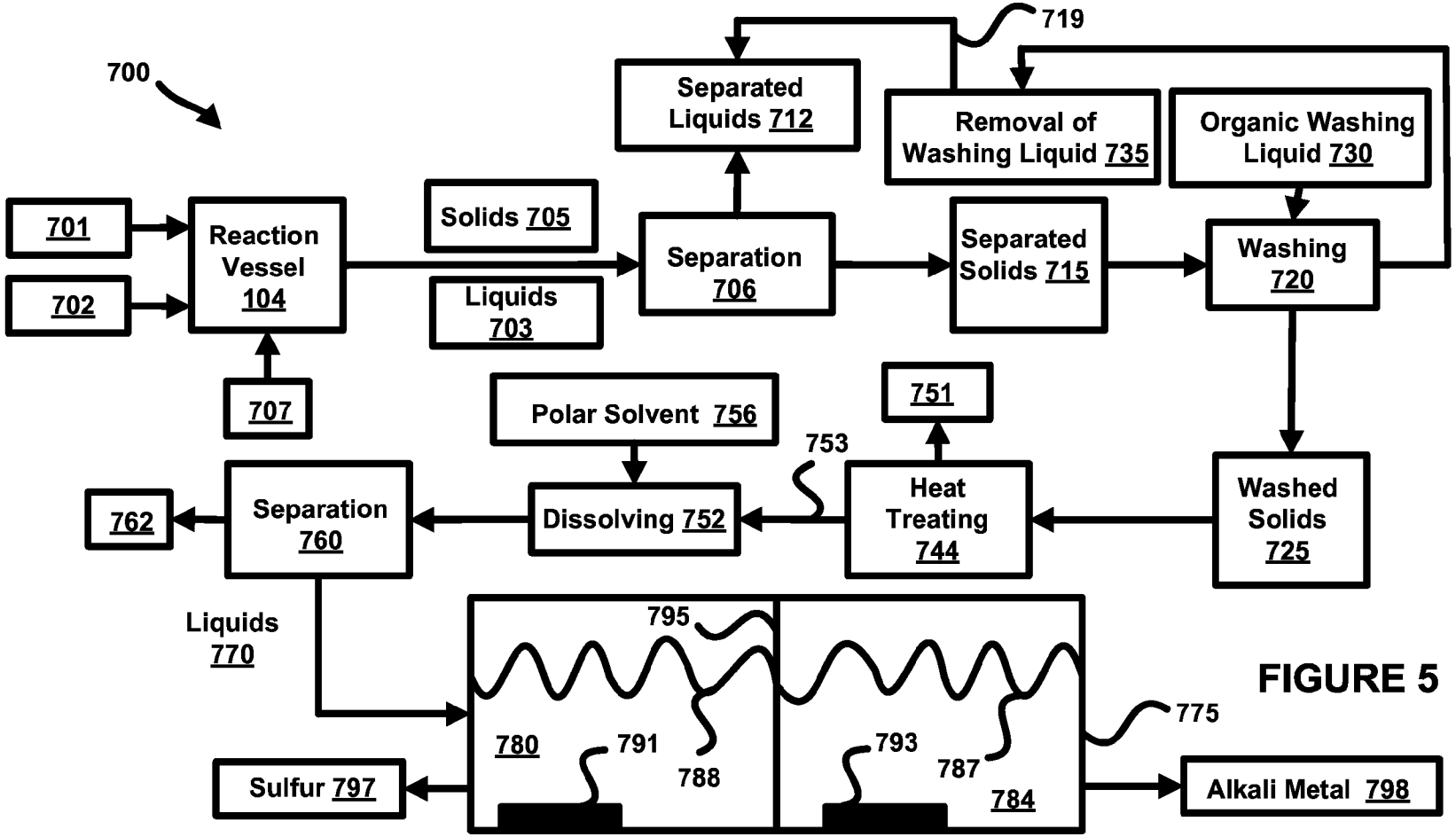
FIG. 5 shows a schematic of another embodiment of a process for upgrading the oil and regenerating the sulfur and alkali metal.

Referring now to FIG. 5, another embodiment of a process 700 for upgrading an oil feedstock is shown schematically. As will be described in greater detail herein, this process 700 removes sulfur, nitrogen and heavy metals from an oil feedstock 701, while at the same time, regenerates the alkali metal 702. Specifically, the process 700 involves reacting an oil feedstock 701 with a quantity of an alkali metal 702. This reaction may occur within a reaction vessel 104 or another suitable vessel. This reaction produces a quantity of solid materials 705 (which may also be referred to as "solids") as well as liquid materials 703 (which may also be referred to as "liquids"). The liquids 703 may be the upgraded oil stream that has a reduced amount of sulfur, nitrogen and heavy metals contained therein. Additionally and/or optionally, a gas 707 may be added to the reactor 104 to facilitate the reaction of the oil feedstock 701 and the alkali metal 702. This reaction with the gas 707 (which may be hydrogen, methane, or another hydrocarbon gas) is described above and in the '874 application.

As shown in FIG. 5, the solids 705 and liquids 703 may be separated from each other. This separation may occur within a separator 706. This separation produces separated liquid materials 712 and separated solids 715. The separated solid materials 715 may then be washed, as shown in washing step 720. This washing may involve washing 720 the solids 715 with an organic washing liquid 730 such as hexane, heptanes, toluene or mixtures of these substances, or natural gas condensate, or another hydrocarbon liquid. The purpose of this washing 720 is to collect any residual oil materials that may have been adhered to the solids 715. (Once washed, the solids may be referred to as "washed solids" or washed solid materials 725.)

After being used to wash the solids, the organic washing liquid 730 may be removed 735. More specifically, the washing liquid 730 will be evaporated off, leaving the organic products that were adhered to the solids 715. These resulting products may then be added/re-mixed with the separated liquids 712, as shown by arrow 719.

The washed solids 725 may then be subjected to a heat treating step 744. In this heat treating step, the solid materials 725 are heated a temperature above 400° C. (and more preferable to a temperature above 500° C.). This heat treating 744 may occur in an atmosphere that has low oxygen and water content. In some embodiments, this may involve heating the solids 725 in an atmosphere comprising one or more of the following gases: nitrogen, helium, neon, argon, krypton, xenon, radon, methane or another hydrocarbon or mixtures of the foregoing. It should be noted that the heat treating step 744 may cause the solid materials 725 to lose mass. This loss of mass also corresponds with an increase in the carbon to hydrogen ratio of the solid material. In other words, the heat treating 744 converts some of the coke/organic product within the solids 725 into gases 751 that are emitted during the heat treatment but may be collected for gas products or process value. These gases may be methane or another hydrocarbon gas. (It is the loss of this gas 751 that causes the mass of the solids 725 to be reduced.) Moreover, because a hydrocarbon gas is emitted (such as methane) the overall carbon to hydrogen ratio within the solid materials 725 may be increased.

After the heat treating 744 has occurred, the remaining solid materials 753 (as represented by an arrow), may be added to a solution comprising a polar solvent 756. More specifically, the solid materials 753 are dissolved 752 (or partially dissolved) in a solution comprising a polar solvent 756. This solution comprising a polar solvent 756 has a boiling temperature above 130° C. and specific gravity less than 2 g/cc. In some embodiments, the solution comprising a polar solvent 756 comprises one or more solvents selected from group consisting of: formamide, methyl formamide, dimethyl formamide, acetamide, methyl acetamide, dimethyl acetamide, ethylene glycol, propylene glycol, 1,2-ethanediol, 1,2-propanediol, propylene carbonate, ethylene carbonate, diethyl carbonate, N-methylpyrrolidone, tetraethylene glycol dimethyl ether (tetralglyme), acetonitrile, dimethyl sulfoxide, liquid ammonia, methyl amine methyl formamide, 1,3-Dimethyl-3,4,5,6-tetrahydro-2(1H)-pyrimidinone (DMPU), and combinations thereof.

The solid materials 753 contain some sulfide, hydrogen sulfide and/or polysulfide anions contained therein. Accordingly, the polar solvent 756 must be selected so that at least some sulfide, hydrogen sulfide and/or polysulfide anions dissolve 752 therein.

After the solid materials 753 are added to the polar solvent 756, a separation 760 may occur in which any remaining solid materials 762 are removed from the polar solvent 756. As noted above, the polar solvent 756 will dissolve or partially dissolve sulfide, hydrogen sulfide or polysulfide anions; accordingly, the resulting liquid 770 may have a yellowish tint from the dissolved sulfur moieties but may also be clear. However, some solids may not dissolve in the solution comprising polar solvent 756. Thus these solids, which are called remaining solid materials 762, can be removed from the liquid.

The solution comprising polar solvent 756 (which includes the liquid 770) is added to an electrolytic cell 775. More specifically, the solution comprising polar solvent 756 may be added to an electrolytic cell 775 that includes an anolyte compartment 780 and a catholyte compartment 784. The solution comprising polar solvent 756 may be added to the anolyte compartment 780. The anolyte compartment 780 may, at least partially, house an anode 791. The anolyte compartment 780 also includes an anolyte 788. The solution comprising polar solvent 756 mixes with/becomes part of the anolyte 788. The anolyte 788 is preferably a liquid material. Further, a portion of the anolyte 788 may serve as the solution comprising polar solvent 756.

The catholyte compartment 784 at least partially houses a cathode 793. The catholyte compartment 784 also includes a catholyte 787. The cell 775 further comprises an alkali ion conductive membrane 795. This membrane 795 is substantially impermeable to sulfide, hydrogen sulfide or polysulfide anions, the catholyte, the anolyte, and sulfur. This membrane 795 separates the catholyte compartment 784 from the anolyte compartment 780. The alkali ion conductive membrane 795 allows alkali metal ions to pass through the alkali metal ion conductive membrane 795 from the anolyte compartment 780 to the catholyte compartment 784. In some embodiments, the alkali ion conductive membrane 795 is selected from the group consisting of an alkali metal conductive ceramic, a glass ceramic; and a solid MSICON (Metal Super Ion CONducting) material, where M is Na or Li.

During operation of the cell, an electrolytic reaction will occur. More specifically, during operation, the electrolytic cell 775 may produce alkali metal 798 in the catholyte compartment 784 (and thus regenerate the alkali metal 702). Likewise, the electrolytic cell 795 (in the anolyte compartment 780) may produce elemental sulfur 797. More specifically, during operation of the electrolytic cell 775, sulfur moeities in the anolyte compartment 780 (from the polysulfide, sulfide and/or hydrogen sulfide anions) are reacted to form polysulfide ions and elemental sulfur 797. Alkali metal ions in the catholyte compartment 784 are reacted to form elemental alkali metal 798. In some embodiments, the cell 775 and/or the anolyte compartment 780 is maintained at a temperature that is greater than or equal to 115° C. such that the produced sulfur 797 is in the liquid phase.

In some embodiments, this operation of the electrolytic cell 775 may occur at a temperature that is below the melting temperature of the alkali metal 798. In these embodiments, solid elemental alkali metal is produced (and may be, for example, plated onto the cathode in the manner outlined above in connection with FIG. 2). In other embodiments, the cell 775 or the catholyte compartment 784 may be heated to a temperature above the melting point of the alkali metal 798 such that the produced alkali metal is molten. If molten, the alkali metal may be removed from the catholyte compartment 784 in a variety of ways, gravimetric, electromagnetic pumping and other methods know by those skilled in the art handling molten metals.

In addition to producing sulfur and alkali metal, polysulfides may be produced.

In order to produce the alkali metal 798, the catholyte 787 in the catholyte compartment may comprise an alkali metal salt selected from the group consisting of an alkali metal chloride, bromide, iodide, perchlorate, and hexafluorophosphate. Further, the catholyte 787 may also include a catholyte solvent selected from group consisting of tetraglyme, diglyme, dimethyl carbonate, dimethoxy ether, propylene carbonate, ethylene carbonate, and diethyl carbonate. Also if the temperature is above the melting temperature of the alkali metal, the molten alkali metal may serve as the catholyte.

Figure 6:
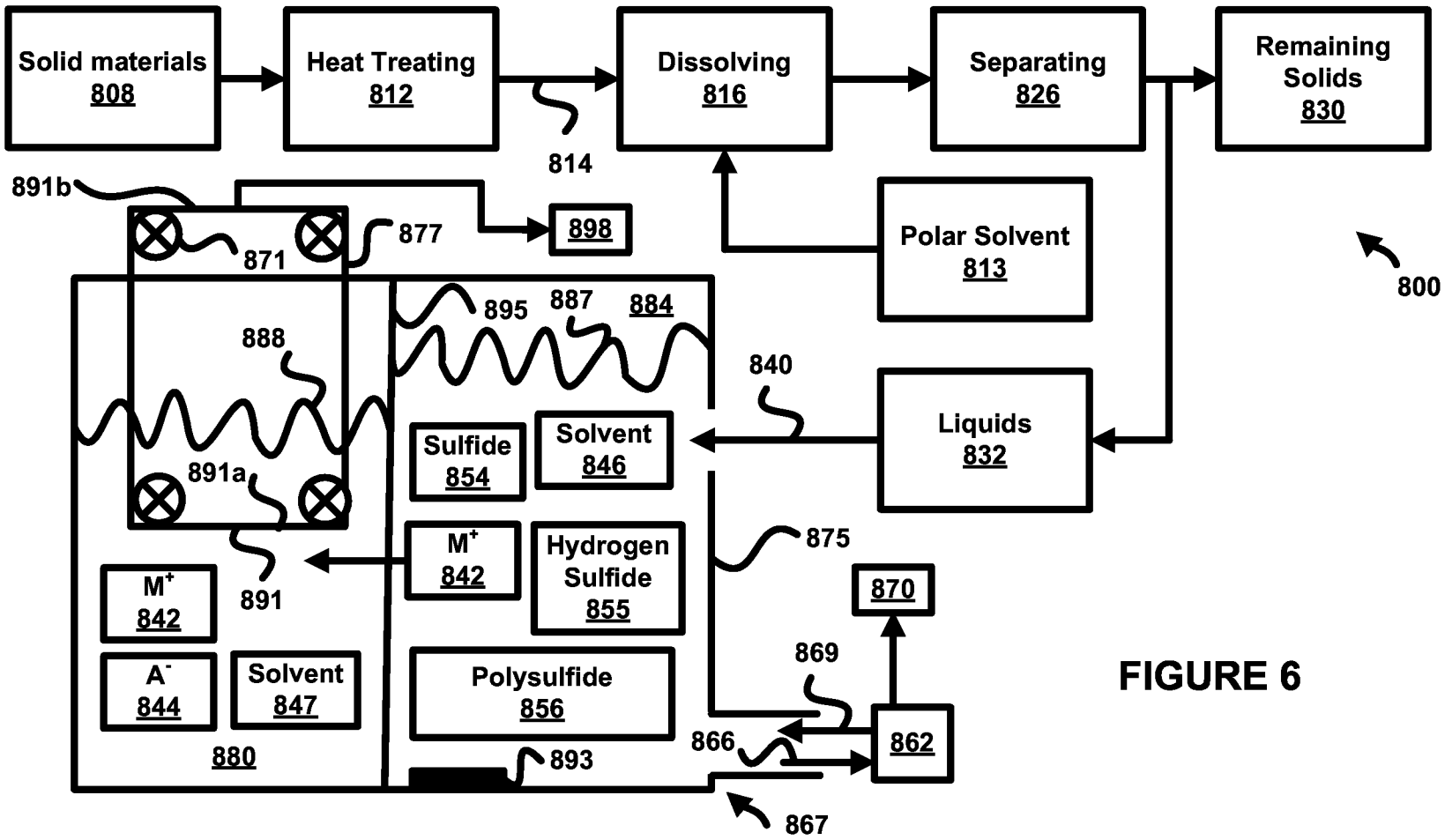
FIG. 6 shows a schematic of another embodiment of a process for upgrading the oil and regenerating the sulfur and alkali metal.

Referring now to FIG. 6, a further process 800 is illustrated in schematic form. The process 800 relates to a method of upgrading an oil feedstock. Specifically, in the process 800 a solid material is obtained 808. This solid material has been formed from the reaction of an oil feedstock with a quantity of an alkali metal, in the manner outlined herein. This solid material will then be heat treated 812 in the manner outlined herein. Such heat treating 812 may involve heating the solid materials to a temperature above 400 or 500° C. under a nitrogen atmosphere (or other inert atmosphere). This heat treating may cause the solid materials to lose mass as a result of some of the organic matter in the solid materials being converted into methane or other gases. The heat treated solid materials are represented in FIG. 6 by arrow 814.

These heat treated solid materials 814 may then be dissolved 816 in a solution comprising polar solvent 813. This dissolving forms a liquid material 832 and a solid material 830. As shown by FIG. 6, the liquid materials may be separated (using separating techniques 826) such that the liquid materials 832 are isolated from the remaining solids 830. These remaining solids 830 may comprise heavy metals or other materials that were formed during the reaction between the organic oil feedstock and the alkali metal. It should be noted that the solution comprising polar solvent 813 used to dissolve the materials may have a boiling temperature above 130° C. and specific gravity less than 2 g/cc. This solution comprising polar solvent 813 should be selected such that sulfide anions, polysulfide anions and/or hydrogen sulfide anions have at least some solubility in the solution comprising polar solvent 813.

As shown in FIG. 6, the liquid materials 832, which includes the solution comprising polar solvent 813 and sulfide anions, polysulfide anions and/or hydrogen sulfide anions is added (as shown by arrow 840) to an electrolytic cell 875. This electrolytic cell 875 may be electrolyzed. In general, this electrolyzing may occur at a temperature that is greater or equal to 115° C. so that any sulfur formed in the cell 875 is in its liquid phase.

The cell 875 comprises an anode 893 and a cathode 891. The anode 893 is at least partially housed in an anolyte compartment 884. The anolyte compartment 884 will generally include a liquid anolyte 887. The liquids 832 mix with the liquid anolyte 887.

The cell 875 may also include a catholyte compartment 880. The anolyte compartment 884 and the catholyte compartment 880 are separated by an alkali metal ion conductive membrane 895.

The liquid anolyte 887 may include a quantity of sulfide anions 854, a quantity of polysulfide anions 856 and/or a quantity of hydrogen sulfide anions 855. An anolyte solvent 846 (which may or may not be the same as the polar solvent 813 used in the dissolving step 816) is also part of the liquid anolyte 887. As part of the reaction at the anode 893, alkali metal ions 842 are formed. These alkali metal ions 842 may be transported across the alkali metal ion conductive membrane 895 from the anolyte compartment 884 to the catholyte compartment 880.

The catholyte compartment 880 also includes a liquid catholyte 888. This catholyte 888 includes a catholyte solvent 847, which may or may not be the same as the solvent 846 in the anolyte compartment 884. The catholyte solvent 847 may be selected from group consisting of tetraglyme, diglyme, dimethyl carbonate, dimethoxy ether, propylene carbonate, ethylene carbonate, and diethyl carbonate. The catholyte 888 may further include an alkali metal salt that is dissolved into alkali metal ions 842 and anions 844. In some embodiment the alkali metal salt is selected from the group consisting of an alkali metal chloride, bromide, iodide, perchlorate, and hexafluorophosphate. As shown in FIG. 6, such alkali metal salts may dissolve and separate into their corresponding ions within the liquid catholyte 888.

The reaction that occurs at the anode 893 will now be described. Specifically, during operation of the electrolytic cell 875, sulfur moieties in the anolyte compartment are reacted to form polysulfide ions 856 and elemental sulfur 870 according to the following reactions:

$$Na_2S_x \rightarrow Na^+ + e^- + 1/2Na_2S_{(2x)}$$

$$Na_2S_x \rightarrow Na^+ + e^- + 1/2Na_2S_x + x/16S_8$$

Where x ranges from 0 to about 8 but may be greater.

As shown in FIG. 6, some of the anolyte 887 may be removed (as shown by arrow 866) from the bottom 867 of the electrolytic cell 875. The removed anolyte 866 comprises a portion of the produced elemental sulfur 870. This elemental sulfur 870 may then be separated from the anolyte 866 via a separator 862. Once separated, the sulfur 870 may then be sold, used etc. Further, after the sulfur 870 has been separated, the anolyte may be returned to the cell 875, as shown by arrow 869. The sulfur free anolyte may also serve as the solution comprising polar solvent, 813. FIG. 4 shows one example of the way in which sulfur 870 may be separated; however, other embodiments for separating the sulfur 870 may also be used.

At the cathode 891, alkali metal ions 842 are reduced to form alkali metal 898. The way in which this occurs, and the way in which the alkali metal 898 may be separated from the cathode 891, will now be described. The cathode 891 includes an inside portion 891*a* that is within the catholyte compartment 880 (and thus in contact with catholyte 888) and an outside portion 891*b* that is outside of the catholyte compartment. More specifically, the cathode 891 comprises a metal band 877 that follows the path of rollers 871. The rollers 871 facilitate the transfer of the outside portion 891*b* to within the cell 875 and facilitate the movement of the inside portion 891*a* outside of the cell 875. The inside portion 891*a* of the cathode 891 can be transferred outside the catholyte compartment 880 and the outside portion 891*b* can be transferred inside the catholyte compartment 880 without substantially interrupting the operation of the electrolytic cell 875. This may occur by having the alkali metal 898 plate onto the inside portion 891*a* of the cathode 891 while this portion is inside the catholyte compartment 880 and then the plated metal 898 is removed (via brushes, scrapers, etc.) from the outside portion 891*b* of the cathode 891 while this portion is outside the catholyte compartment 880. Of course, those skilled in the art will appreciate that FIG. 6 shows only one example of the way in which the formed alkali metal 898 may be collected. Other embodiments may also be used.

In view of the foregoing, it will be appreciated that the disclosed invention includes one or more of the following advantages:

operating an electrolytic cell to process an alkali metal sulfide or polysulfide at temperatures below the melting temperature of the alkali metal;

operating an electrolytic cell continuously or semi-continuously to process an alkali metal sulfide or polysulfide at temperatures below the melting temperature of the alkali metal;

removing an alkali metal continuously or semi-continuously in solid form from the cell;

removing high alkali metal polysulfides and dissolved sulfur continuously or semi-continuously from the electrolytic cell, thereby reducing polarization of the anode by sulfur;

separating sulfur continuously or semi-continuously from a stream containing a mixture of solvent, sulfur, and alkali metal polysulfides such that the solvent and alkali metal polysulfides are substantially recovered such that they can be returned back to an electrolytic process;

providing an apparatus and method for regenerating hydrogen sulfide from and alkali metal hydrosulfide; and operating the electrolytic cells at low temperatures and pressures, so that the electrolytic cell materials of construction can include materials which would not tolerate elevated temperature.

An additional post treatment that may be used to reduce the alkali metal content in the petroleum product is to use electrostatic separators to remove suspended alkali metal sulfides or other alkali metal salts such as napthanic acid salts. The equipment utilized may be equipment found typically such as offered by AMR Process Inc. of Leduc, Alberta. The process of removing alkali metal species may further be assisted with the addition of water to the petroleum product and desalting with such electrostatic equipment.

Figure 7:
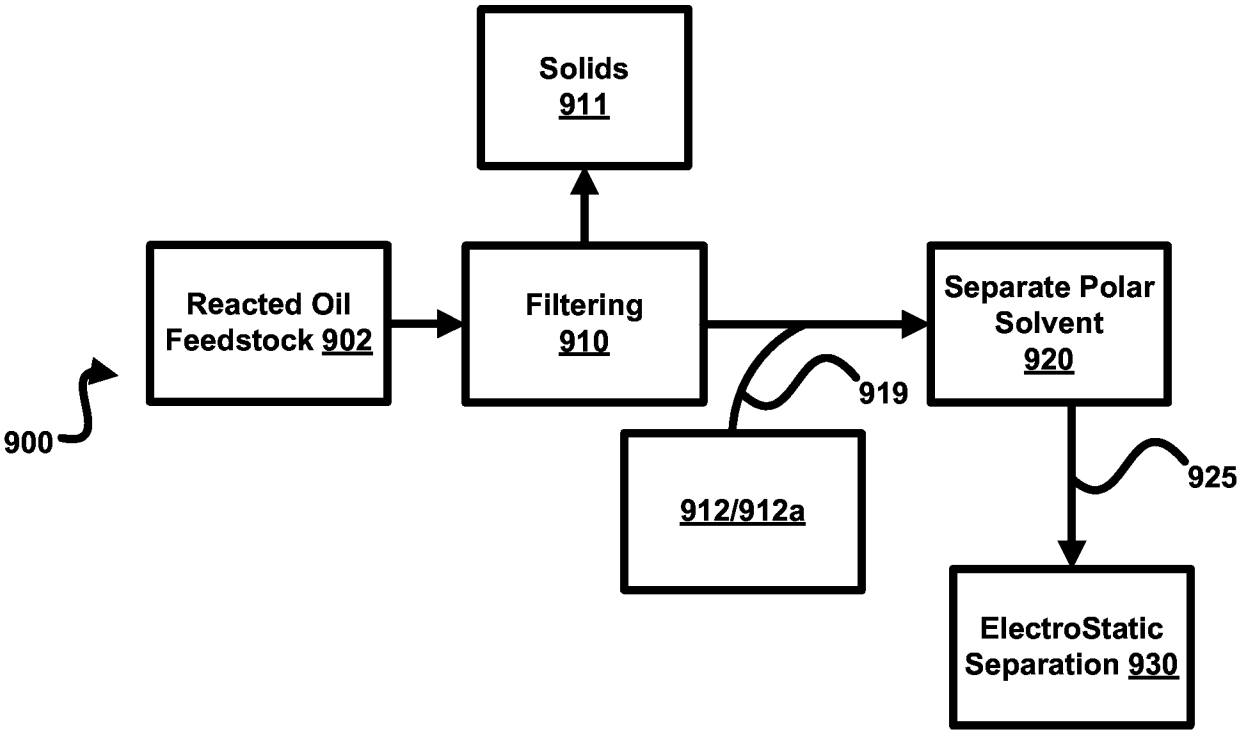
FIG. 7 shows a schematic drawing of a process for upgrading the oil feedstock that includes post-treating the petroleum liquid.

Referring now to FIG. 7, a schematic drawing of a process 900 for upgrading the oil feedstock that includes this post-treatment method is illustrated. Specifically, a quantity of reacted oil feedstock 902 is obtained. This oil feedstock has been reacted by having an oil feedstock react with an alkali metal (such as, for example, a molten alkali metal). (As described above, this reaction may or may not include an additional gas, such as hydrogen, methane, etc.) Thus, in the process 900, the reacted oil feedstock may be the upgraded oil 111, the liquid that was sent to separator 114, the liquid 602, the liquid 703 or another reacted oil feedstock material.

In the process 900, the reacted feedstock 902 may be filtered 910, such that filtered solids 911 are removed. This filtering may remove suspended solids such as suspended alkali metal sulfides or other alkali metal salts such as napthanic acid salts. Once filtered, a solution comprising polar solvent 912 may be added to the liquid (as shown by line 919). In some embodiments, the solution comprising polar solvent 912 comprises water 912*a*. However, other polar solvents may be used as the solution comprising polar solvent 912. This solution comprising polar solvent 912 may include water mixed with another polar solvent. This polar solvent 912/water 912*a* is designed to dissolve alkali metal salts that are present in the liquid stream.

Once the polar solvent 912 and/or water 912*a* has been added, the polar solvent 912/water 912*a* may be separated 920 from the liquid 925 (which is represented by an arrow). The dissolved alkali metals salts and/or napthanic acid salts will generally separate into the solution comprising polar solvent 912/water 912*a*. Accordingly, when this phase is removed, the amount of these materials in the liquid 925 will be decreased. In order to further aid in this separation process, an electrostatic separator 930 may be used. An exemplary electrostatic separator is available from AMR Process Inc. of Leduc, Alberta, and may involve a desalting process that is used with the liquid 925. Once this separation process is completed, the upgraded oil will have a reduced amount of alkali metal containing materials found therein, and thus may be worth more and/or more easily refined/processed into a fuel product.

EXAMPLES

The following example is provided below which discusses one specific embodiment within the scope of the invention. This embodiment is exemplary in nature and should not be construed to limit the scope of the invention in any way.

Sodium was reacted with bitumen which originally contained 5% sulfur. Solids were separated from the treated bitumen by centrifugation. The solids where rinsed with toluene. The toluene rinse was heated to strip off the toluene which was collected in a condenser. The remaining liquid was added back to the product liquid (e.g., the liquid portion of the product obtained from the reaction of bitumen and sodium). 97% of the sulfur had been removed from the liquid product (according to test results) and the API gravity of the liquid product increased from 8 to 19.

The solids that were washed with toluene contained over 50% carbon and were inter-mixed with sodium sulfide. The solids were heated to 600° C. for one hour under nitrogen and cooled. Following the treatment the solids were powdery. X-ray diffractometry indicated the mixture of solid materials contained considerable sodium sulfide.

A polar organic solvent was mixed with the heat treated solids. The polar solvent liquid went from clear to yellow indicating dissolution of the sodium sulfide. The liquid solution was filtered to remove any undissolvable solids and then the liquid was added to an electrolysis cell with NaSICON membrane. The cell was operated at 130° C. and constant current of 60 milliamps per centimeter squared current density. The cell initially had an open circuit potential of 1.8 V which later steadily rose to 2.5 V at which time 95% of the sulfur had been electrochemically reduced to its elemental form.

An electrolytic flow cell may utilize a 1" diameter NaSICON membrane with approximately 3.2 $cm^2$ active area. The NaSICON is sealed to a scaffold comprised of a non-conductive material that is also tolerant of the environment. One suitable scaffold material is alumina. Glass may be used as the seal material. The flow path of electrolytes will be through a gap between electrodes and the membrane. The anode (sulfur electrode) may be comprised of graphite or titanium among other materials. The cathode may be either aluminum or stainless steel. It is within the scope of the invention to configure the flow cell with a bipolar electrodes design. Anolyte and catholyte solutions may each have a reservoir and pump. The anolyte reservoir may have an agitator. The entire system may preferably have temperature control with a maximum temperature of 150° C. and also be configured to be bathed in a dry cover gas. The system preferably may also have a power supply capable of delivering to 5 VDC and up to 100 $mA/cm^2$.

As much as possible, materials will be selected for construction that are corrosion resistant with the expected conditions. The flow cell will be designed such that the gap between electrodes and membrane can be varied.

While specific embodiments of the present invention have been illustrated and described, numerous modifications come to mind without significantly departing from the spirit of the invention, and the scope of protection is only limited by the scope of the accompanying claims.

All the patent applications and patents listed herein are expressly incorporated herein by reference.

What is claimed is:

1. A process for upgrading an oil feedstock comprising: reacting an oil feedstock with a quantity of an alkali metal, wherein the reaction produces solid materials and liquid materials;

separating the solid materials from the liquid materials; heat treating the solid material to a temperature above 400° C. in an atmosphere that has a low oxygen and water content and causing the solid material to lose mass, wherein the heat treated solid material has an increased carbon to hydrogen ratio and wherein said atmosphere comprises one more of the following gases: nitrogen, helium, neon, argon, krypton, xenon, radon, methane or another hydrocarbon and mixtures thereof; adding the solid materials to a solution comprising a polar solvent, wherein at least some sulfide hydrogen sulfide, or polysulfide anions found in the solid material dissolve in the solution comprising polar solvent; adding the solution comprising polar solvent to an electrolytic cell, wherein during operation, the electrolytic cell produces an alkali metal, polysulfide's and sulfur.

2. The process according to claim 1, wherein the solution comprising polar solvent has a boiling temperature above 130° C. and specific gravity of less than 2 g/cc.

3. The process according to claim 2, wherein the polar solvent comprises one or more solvents selected from group consisting of:

formamide, methyl formamide, dimethyl formamide, acetamide, methyl acetamide, dimethyl acetamide, ethylene glycol, propylene glycol, 1,2-ethanediol, 1,2-propanediol, propylene carbonate, ethylene carbonate, diethyl carbonate, N-methyl pyrrolidone, tetraethylene glycol dimethyl ether (tetralglyme), acetonitrile, dimethyl sulfoxide, liquid ammonia, methyl amine methyl formamide, 1,3-Dimethyl-3,4,5,6-tetrahydro-2(1H)-pyrimidinone (DMPU), and combinations thereof.

4. The process according to claim 1, wherein during operation, the electrolytic cell is heated to a temperature that is below the melting temperature of the alkali metal.

5. The process according to claim 4, wherein the electrolytic cell comprises:

a cathode;

a catholyte compartment comprising a catholyte;

an anode;

an anolyte compartment comprising an anolyte;

an alkali ion conductive membrane that is substantially impermeable to sulfide, hydrogen sulfide or polysulfide anions, the catholyte, the anolyte, and sulfur, wherein the solution comprising polar solvent is added to the anolyte compartment;

wherein during operation of the electrolytic cell, anions in the anolyte compartment are reacted to form polysulfide anions and elemental sulfur; and wherein alkali metal ions in the catholyte compartment are reacted to form the alkali metal.

6. The process according to claim 5, wherein the alkali ion conductive membrane allows alkali metal ions to pass through the alkali metal ion conductive membrane from the anolyte compartment to the catholyte compartment, wherein the alkali ion conductive membrane is selected from the group consisting of:

alkali metal conductive ceramic;

a glass ceramic; and a solid MSICON (Metal Super Ion CONducting) material, where M is Na or Li.

7. The process according to claim 6, wherein the cathode comprises molten alkali metal, wherein the molten alkali metal is removed from the catholyte compartment.

8. The process according to claim 5, wherein the catholyte comprises an alkali metal ions and corresponding anions; and a catholyte solvent selected from group consisting of tetraglyme, diglyme, dimethyl carbonate, dimethoxy ether, propylene carbonate, ethylene carbonate, and diethyl carbonate.

9. The process according to claim 8, wherein the alkali metal ions are reduced to form the alkali metal at a temperature below the melting temperature of the alkali metal.

10. The process according to claim 5, wherein the cathode in part is in contact with the catholyte within the catholyte compartment and the cathode in part is outside the catholyte compartment.

11. The process according to claim 10, wherein the part of the cathode within the catholyte compartment can be transferred outside the catholyte compartment and the part of the cathode outside the catholyte compartment can be transferred inside the catholyte compartment.

12. The process according to claim 10, wherein the cathode consists of a metal band following the path of rollers.

13. The process according to claim 10, wherein the alkali metal plates onto the part of the cathode that is inside the catholyte compartment and the alkali metal is removed from the cathode from the part of the cathode that is outside the catholyte compartment.

14. The process according to claim 1, wherein during operation, the cell is maintained at a temperature at or above 115° C. such that the produced sulfur is in the liquid phase.

15. The process according to claim 14, wherein anolyte is removed from the bottom of the electrolytic cell, wherein the removed anolyte comprises a portion of the sulfur, wherein the sulfur is separated from the anolyte and the anolyte is returned to the electrolytic cell.

16. The process according to claim 1, wherein the anolyte comprises the solution comprising polar solvent.

17. The process according to claim 1, wherein prior to heat treating the solid materials, the solid materials are washed with hexane, heptane, toluene, or mixtures of these substances, or natural gas condensate, or other hydrocarbon liquid.

18. The process according to claim 17, wherein after the solid materials are added to the solution comprising polar solvent, any remaining solid materials are removed from the solution comprising polar solvent prior to the solution comprising polar solvent being added to the electrolytic cell.

19. The process according to claim 1, wherein during the reaction between the oil feedstock and the quantity of the alkali metal, a gas comprising a hydrocarbon or hydrogen is added.

20. The process according to claim 1, further comprising filtering the liquid materials formed from the reaction of the oil feedstock with the quantity of the alkali metal.

21. The process according to claim 20, wherein a second solution comprising polar solvent is added to the filtered liquid materials.

22. The process according to claim 21, wherein the second polar solvent comprises water.

23. The process according to claim 21, wherein the second polar solvent is separated from the filtered liquid materials.

24. The process according to claim 23, wherein the separation of the filtered liquid materials from the second polar solvent uses electrostatics.

25. A process for upgrading an oil feedstock comprising:

obtaining solid materials that were formed from the reaction of an oil feedstock with a quantity of an alkali metal;

heat treating the solid materials, wherein heat treating the solid materials comprises heating the solid materials to a temperature above 500° C. under a nitrogen atmosphere, wherein the heat treating causes the solid materials to lose mass;

dissolving the heat treated solid materials in a solution comprising polar solvent, thereby forming a liquid material, wherein the polar solvent has a boiling temperature above 130° C. and specific gravity less than 2 g/cc;

separating out any remaining solid materials from the liquid material;

adding the liquid material to an anolyte compartment of an electrolytic cell;

electrolyzing the electrolytic cell to produce sulfur and an alkali metal, wherein the electrolyzing occurs at a temperature of 115° C. or greater.

26. The process according to claim 25 further comprising:

washing the solid materials with toluene, heptane, hexane, or mixtures of these substances, or natural gas condensate, or another hydrocarbon liquid, wherein the washing of the solid materials is performed prior to the solid materials being heat treated.

* * * * *